US008141313B2

(12) United States Patent
Dagher et al.

(10) Patent No.: US 8,141,313 B2
(45) Date of Patent: Mar. 27, 2012

(54) INTERLOCKING ROOFING PANEL SYSTEM

(76) Inventors: Habib J. Dagher, Veazie, ME (US); William G. Davids, Bangor, ME (US)

( * ) Notice: Subject to any disclaimer, the term of this patent is extended or adjusted under 35 U.S.C. 154(b) by 0 days.

(21) Appl. No.: 12/963,870

(22) Filed: Dec. 9, 2010

(65) Prior Publication Data

US 2011/0072746 A1 Mar. 31, 2011

Related U.S. Application Data

(63) Continuation-in-part of application No. 12/246,090, filed on Oct. 6, 2008, now Pat. No. 8,046,969.

(60) Provisional application No. 60/998,055, filed on Oct. 5, 2007.

(51) Int. Cl.
*E04B 2/00* (2006.01)

(52) U.S. Cl. ..... 52/588.1; 52/591.4; 52/793.11; 52/794.1; 52/745.06; 52/302.3

(58) Field of Classification Search ..... 52/90.1, 52/91.1, 302.1, 302.3, 302.4, 407.3, 404.4, 52/793.1, 793.11, 794.1, 591.4, 790.1, 271, 52/270, 783.1, 588.1, 592.1, 745.06, 745.15; 428/192

See application file for complete search history.

(56) References Cited

U.S. PATENT DOCUMENTS 1,156,753 A * 10/1915 Carey ..... 52/592.1
2,053,135 A * 9/1936 Dalton ..... 52/801.11
2,054,694 A * 9/1936 Eldredge ..... 52/793.11
2,159,300 A * 5/1939 Tashjian ..... 52/591.1
2,931,468 A * 4/1960 Keller ..... 428/46
3,086,323 A * 4/1963 Pine ..... 52/22

(Continued)

FOREIGN PATENT DOCUMENTS

GB 2108546 A 9/1981

(Continued)

OTHER PUBLICATIONS

Interview Summary dated Sep. 28, 2010, U.S. Appl. No. 12/246,090, filed Oct. 6, 2008.

(Continued)

*Primary Examiner* — Robert Canfield
*Assistant Examiner* — Babajide Demuren
(74) *Attorney, Agent, or Firm* — MacMillan, Sobanski & Todd, LLC

(57) ABSTRACT

A roofing system includes a plurality of roofing panel assemblies. Each roofing panel assembly includes a base having a substantially planar surface, a plurality of I-joists having an upper flange and a lower flange, wherein the base is attached to the lower flanges of the plurality of I-joists, and a cap having a substantially planar surface, wherein the cap is attached to the upper flanges of the plurality of I-joists. The plurality of I-joists includes a first edge most I-joist and a second edge most I-joist. A first edge of the cap is attached to the upper flange of the first edge most I-joist such that a portion of the upper flange of the first edge most I-joist is not covered by the cap. A second edge of the cap extends beyond an edge of the second edge most I-joist for a distance less than a width of the upper flange of the second edge most I-joist. Adjacent roofing panel assemblies are attached such that the second edge of the cap engages the portion of the upper flange of the first edge most I-joist not covered by the cap.

10 Claims, 9 Drawing Sheets

U.S. PATENT DOCUMENTS

| | | | | | |
|---|---|---|---|---|---|
| 3,732,138 | A | * | 5/1973 | Almog | 428/114 |
| 3,886,706 | A | | 6/1975 | Baker | |
| 4,329,827 | A | | 5/1982 | Thorn | |
| 4,445,305 | A | * | 5/1984 | Orie, Sr. | 52/309.9 |
| 4,593,509 | A | * | 6/1986 | Linton | 52/262 |
| 4,724,651 | A | * | 2/1988 | Fligg | 52/742.13 |
| 5,157,892 | A | * | 10/1992 | Ryther | 52/793.11 |
| 5,365,705 | A | * | 11/1994 | Crowley et al. | 52/90.1 |
| 5,487,930 | A | * | 1/1996 | Lockshaw et al. | 428/53 |
| 5,638,651 | A | * | 6/1997 | Ford | 52/309.7 |
| 6,085,485 | A | | 7/2000 | Murdock | |
| 2002/0069600 | A1 | * | 6/2002 | Bryant | 52/309.9 |
| 2006/0254208 | A1 | | 11/2006 | Clark et al. | |
| 2006/0272280 | A1 | * | 12/2006 | Romes et al. | 52/794.1 |

FOREIGN PATENT DOCUMENTS

GB 2108546 A * 5/1983

OTHER PUBLICATIONS

Interview Summary dated Apr. 1, 2011, U.S. Appl. No. 12/246,090, filed Oct. 6, 2008.

Notice of Allowance and Fee(s) Due dated Aug. 12, 2011, U.S. Appl. No. 12/246,090, filed Oct. 6, 2008.

Office Action dated Apr. 2, 2010, U.S. Appl. No. 12/246,090, filed Oct. 6, 2008.

Office Action dated Sep. 1, 2010, U.S. Appl. No. 12/246,090, filed Oct. 6, 2008.

Office Action dated Nov. 10, 2010, U.S. Appl. No. 12/246,090, filed Oct. 6, 2008.

Office Action dated Feb. 25, 2011, U.S. Appl. No. 12/246,090, filed Oct. 6, 2008.

Office Action dated Apr. 14, 2011, U.S. Appl. No. 12/246,090, filed Oct. 6, 2008.

Response to the Office Action dated Apr. 2, 2010, filed Aug. 9, 2010, U.S. Appl. No. 12/246,090, filed Oct. 6, 2008.

Response to the Office Action dated Sep. 1, 2010, filed Oct. 25, 2010, U.S. Appl. No. 12/246,090, filed Oct. 6, 2008.

Response to the Office Action dated Nov. 10, 2010, filed Jan. 11, 2011, U.S. Appl. No. 12/246,090, filed Oct. 6, 2008.

Request for Reconsideration response to the Office Action dated Feb. 25, 2011, filed Mar. 21, 2011, U.S. Appl. No. 12/246,090, filed Oct. 6, 2008.

Amendment After Final response to the Office Action dated Apr. 14, 2011 filed Jul. 14, 2011, U.S. Appl. No. 12/246,090 filed Oct. 6, 2008.

* cited by examiner

INTERLOCKING ROOFING PANEL SYSTEM

BACKGROUND OF THE INVENTION

This invention relates in general to roofing systems for structures. More particularly, this invention relates to a roofing system comprising a plurality of pre-fabricated roofing panel assemblies. Conventional roof systems are principally of three types: Conventionally framed, truss framed, and structural insulated panels. Conventionally framed roofs are the oldest of these systems. They are built on-site, and require no special materials. However, a conventionally framed roof requires skilled labor to properly cut and build the frame. A truss framed roof uses custom-designed frames. After installation of the trusses, interior finish materials and exterior sheathing must be installed. Structural insulated panels incorporating sheathing and insulation are installed over a structural frame and allow for quicker construction.

SUMMARY OF THE INVENTION

This invention relates to a roofing system. The roofing system includes a plurality of roofing panel assemblies. Each roofing panel assembly includes a base having a substantially planar surface, a plurality of I-joists having an upper flange and a lower flange, wherein the base is attached to the lower flanges of the plurality of I-joists, and a cap having a substantially planar surface, wherein the cap is attached to the upper flanges of the plurality of I-joists. The plurality of I-joists includes a first edge most I-joist and a second edge most I-joist. A first edge of the cap is attached to the upper flange of the first edge most I-joist such that a portion of the upper flange of the first edge most I-joist is not covered by the cap. A second edge of the cap extends beyond an edge of the second edge most I-joist for a distance less than a width of the upper flange of the second edge most I-joist. Adjacent roofing panel assemblies are attached such that the second edge of the cap engages the portion of the upper flange of the first edge most I-joist not covered by the cap.

Another embodiment of a roofing system includes a plurality of roofing panel assemblies. Each roofing panel assembly includes a plurality of I-joists having an upper flange and a lower flange, a base having a substantially planar surface, wherein the base is attached to the lower flanges of the plurality of I-joists, and a cap having a substantially planar surface, wherein the cap is attached to the upper flanges of the plurality of I-joists. The plurality of I-joists includes a first edge most I-joist and a second edge most I-joist. A first edge of the base extends beyond an edge of the first edge most I-joist for a distance less than a width of the lower flange of the first edge most I-joist. A second edge of the base is attached to the lower flange of the second edge most I-joist such that a portion of the lower flange of the second edge most I-joist is not covered by the base. The first edge of the base of one roofing panel assembly engages the portion of the lower flange of the second edge most I-joist not covered by the base of an adjacent roofing panel assembly.

An additional embodiment of a roofing system includes a plurality of roofing panel assemblies. Each roofing panel assembly includes a base having a substantially planar surface, a plurality of I-joists having an upper flange, a lower flange, and a web, and a cap having a substantially planar surface, wherein the cap is attached to the upper flange of one or more of the plurality of I-joists. The upper flange defines an upper notch and one edge of the web is inserted into the upper notch. The lower flange defines a lower notch and one edge of the web is inserted into the lower notch. The base is attached to the lower flange of one or more of the plurality of I-joists and the I-joists are configured such that one or more cells are created between adjacent I-joists. Ventilation openings are configured to provide air communication from one of one cell to at least one adjacent cell, and from one cell to the exterior of the roofing panel assembly. The plurality of I-joists includes a first edge most I-joist and a second edge most I-joist. A first edge of the cap is attached to the upper flange of the first edge most I-joist such that a portion of the upper flange of the first edge most I-joist is not covered by the cap. A second edge of the cap extends beyond an edge of the second edge most I-joist for a distance less than a width of the upper flange of the second edge most I-joist. Adjacent roofing panel assemblies are attached such that the second attachment edge of the cap engages the portion of the upper flange of the first edge most I-joist not covered by the cap.

Various aspects of this invention will become apparent to those skilled in the art from the following detailed description of the preferred embodiment, when read in light of the accompanying drawings.

DETAILED DESCRIPTION

Figure 1:
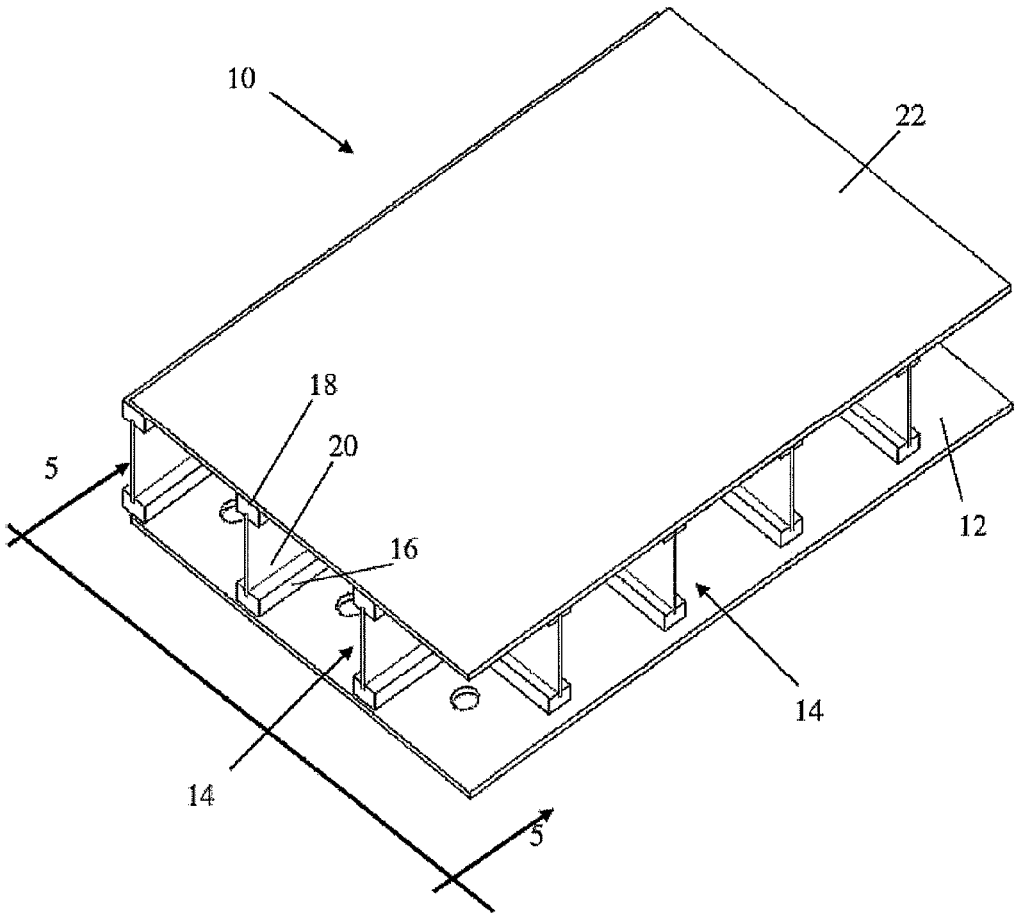
FIG. 1 is a perspective view of one embodiment of a roofing panel assembly.

Referring now to the drawings, there is illustrated in FIG. 1 a roofing panel assembly 10. The roofing panel assembly 10 is pre-fabricated using a base 12. The illustrated base 12 is a substantially planar surface made of oriented strand board (OSB), but it could be made of plywood or other suitable material. The roofing panel assembly 10 includes I-joists, indicated generally at 14. The illustrated I-joists 14 include a lower flange 16 and an upper flange 18. The illustrated lower flange 16 and upper flange 18 are made of pine lumber, though any suitable material can be used including, for example, other types of wood, metal and composite materials. The illustrated I-joists 14 also include a web 20. The illustrated web 20 is made of plywood, but it could be made of OSB or other suitable material including, for example, other types of wood, metal and composite materials. The web 20 is attached to lower flange 16 and upper flange 18. Lower flange 16 is attached to the base 12. Lower flange 16 and base 12 can be attached by any suitable method including adhesives, screws, or nails. A cap 22 is attached to upper flange 18. Upper flange 18 and cap 22 can be attached by any suitable method including adhesives, screws, or nails. The illustrated cap 22 is a substantially planar surface made of OSB, but it could be made of plywood or other suitable material. It should be appreciated that every I-flange 14 does not have to be attached to the base 12 and the cap 22. I-flanges 14 might only be attached to the base 12, to allow for movement of the cap 22 in some locations, for instance. Alternatively, in another embodiment, I-flanges 14 might be attached to other I-flanges, rather than to the base 12 or the cap 22. It should be appreciated that the connections between parts of the roofing panel assembly 10 can include brackets (not shown) made of metal or other suitable material. These brackets can provide reinforcement to connections, or can aid in the assembly of the roofing panel assembly.

It should also be appreciated that that while the base 12 and the cap 22 are illustrated as being substantially parallel to each other, this is not necessary. The base 12 and the cap 22 could be oriented with different slopes.

Figure 5:
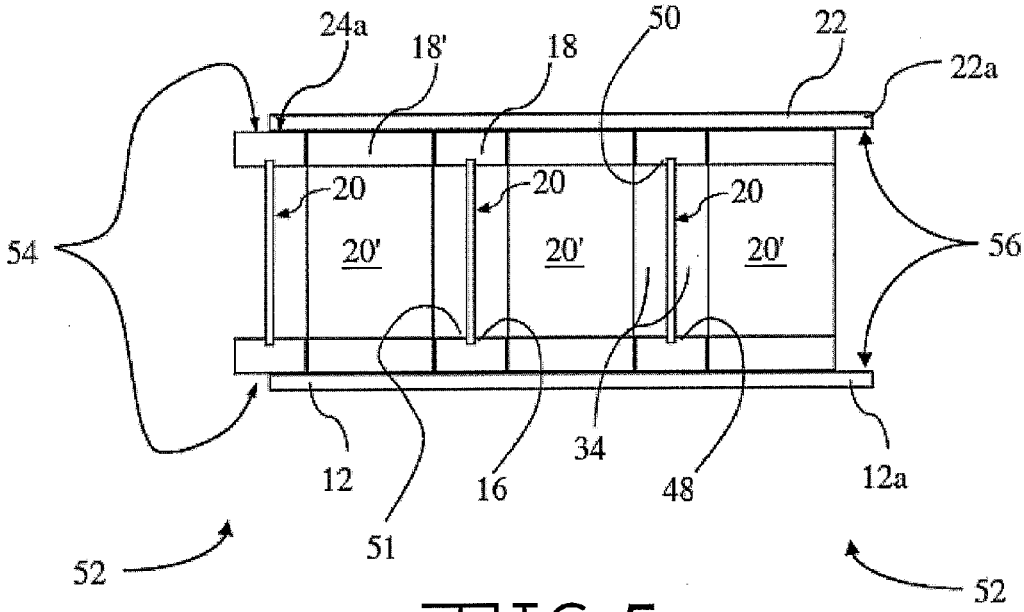
FIG. 5 is an elevational view of the roofing panel assembly of FIG. 1, the view taken along the line 5-5 of FIG. 1.

As best shown in FIG. 5, the lower flange 16 defines a lower notch 48, and the upper flange 18 defines an upper notch 50. As illustrated, the lower notch 48 accommodates one edge of the web 20. That is, one edge of the web 20 is inserted into the lower notch 48. The lower flange 16 is attached to the web 20 by any suitable method, such as by adhesives. It should be appreciated that the lower notch 48 can extend through the lower flange 16 to a greater or lesser depth than illustrated. For example, the lower notch 48 may extend through the entire thickness of the lower flange 16. In that case, the lower flange 16 would appear to be reinforcement on either side of the web 20. A reinforcement (not shown), can be placed in the corner 51 between the lower flange 16 and the web 20. The reinforcement could be plastic, glue, caulk, wood strips, metal brackets, or any other suitable reinforcement. As illustrated, the upper notch 50 accommodates one edge of the web 20. That is, one edge of the web 20 is inserted into the upper notch 50. The upper flange 18 is attached to the web 20 by any suitable method, such as by adhesives. A reinforcement (not shown), can be placed in the corner between the upper flange 18 and the web 20. The reinforcement could be plastic, glue, or any other suitable reinforcement. Although one construction of I-joists 14 has been described, it should be appreciated that the I-joists may be made of other suitable materials and by other suitable methods. For example, the I-joists could be made of plastic or partially of plastics using a pultrusion process.

Figure 2:
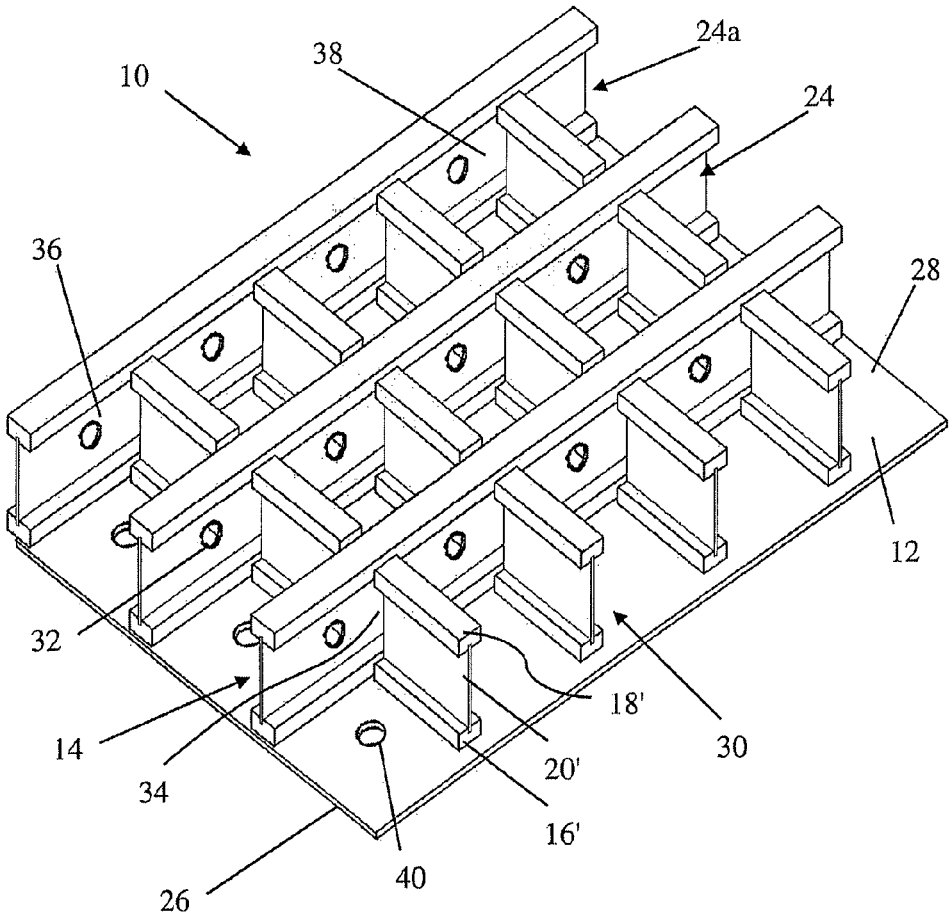
FIG. 2 is a perspective view of the roofing panel assembly in FIG. 1, in which the cap is removed to show the I-joists, cells, and ventilation openings.

Referring now to FIG. 2, the roofing panel assembly 10 of FIG. 1 is shown with the cap 22 removed. The illustrated roofing panel assembly 10 includes longitudinal joists 24. The illustrated longitudinal joists 24 are continuous, and extend from a soffit edge 26 of the base 12 to a second edge 28 of the base 12. The illustrated roofing panel assembly 10 also includes lateral joists 30. Illustrated lateral joists 30 are substantially perpendicular to the longitudinal joists 24. Lateral joists 30 are not continuous, and consist of individual sections disposed between the longitudinal joists 24. In the figures, the lower flange, upper flange, and web of the lateral joists 30 are identified at 16', 18', and 20', respectively. It should be appreciated that other configurations of I-joists 14 can be used within the roofing panel assembly. For instance, the longitudinal joists 24 could be individual sections between continuous lateral joists 30. In the illustrated roofing panel assembly 10, I-joists 14 are sixteen inches apart, though it should be appreciated that some other spaces of I-joists can be used. Additional I-joists can be located where load-bearing strength is required for the roofing panel assembly 10. The illustrated configuration of longitudinal joists 24 and lateral joists 30 provides a grid pattern of I-joists that define separate cells or interior spaces 38. It should be appreciated that the I-joists 14 do not need to be situated in a substantially perpendicular grid, so the interior spaces 38 could have a different shape from that shown. It should be appreciated that including both the longitudinal joists 24 and lateral joists 30 increase the load-bearing capacity of the roofing panel assembly 10, but the roofing panel assembly 10 could be constructed with I-joists 14 oriented substantially in only one direction. In that case, the interior spaces 38 would exist along the full length of the roofing panel assembly 10. Further, it should be appreciated that the roofing panel assembly 10 could include fewer I-joists 14 than illustrated, and the roofing panel assembly 10 could define only a single interior space 38.

The illustrated roofing panel assembly 10 is internally vented. The optional internal venting helps air to move through the roofing panel assembly 10. Providing internal venting helps heat and moisture move out of the roofing panel assembly 10, and helps increase the lifespan, durability and insulation capability of the roofing panel 10. Providing the internal venting helps to reduce condensation on and in the roofing panel assembly, and helps prevent the formation of ice dams. Several types of ventilation openings are illustrated in FIG. 2, and are described in the following paragraphs.

The illustrated roofing panel assembly 10 includes internal vents 32 in the longitudinal joists 24. Internal vents 32 are configured to allow air communication between the two sides of the longitudinal joists 24. The illustrated internal vents 32 are holes with a circular cross-section cut through the web 20. In the illustrated roofing panel assembly 10, there is one internal vent 32 on the longitudinal joist 24 between the lateral joists 30. It should be appreciated that some other number or configuration can be used for internal vents 32.

As best shown in FIG. 5, the illustrated roofing panel assembly 10 also includes gaps 34 between the longitudinal joists 24 and the lateral joists 30. Gaps 34 are configured to allow air communication between the two sides of the lateral joists 30. The illustrated gaps 34 are spaces between the web 20 of the longitudinal joists 24 and the web 20' of the lateral joists 30. These spaces extend from the top of the lower flange 16 to the bottom of the upper flange 18. In the illustrated roofing panel assembly 10, there is a gap 34 at every junction of longitudinal joists 24 and lateral joists 30. This is not necessary, and the gaps could have a different configuration or there could be a different number of gaps 34. It should be appreciated that air communication between the two sides of the lateral joists 30 could be accomplished by some other means, such as by providing vents through the lateral joists 30.

Referring back to FIG. 2, the illustrated roofing panel assembly 10 includes lateral vents 36 in the edge-most longitudinal joist 24*a*. Lateral vents 36 are configured to allow air communication between the two sides of the edge-most longitudinal joist 24*a*. The edge-most longitudinal joist 24*a* is the longitudinal joist 24 that is located near the edge of the roofing panel assembly 10. The lateral vents 36 allow air communication between the interior space 38 of the roofing panel assembly 10 and the exterior of the roofing panel assembly 10. The illustrated lateral vents 36 are holes with a circular cross-section cut through the web 20. In the illustrated roofing panel assembly 10, there is one lateral vent 36 on the longitudinal joist between each pair of the lateral joists 30. This is not necessary, and the lateral vents 36 could have a different configuration or there could be a different number of lateral vents 36. It should be readily appreciated that the illustrated lateral vents 36 are similar to the internal vents 32, except that the lateral vents 36 are located on the edge-most longitudinal joist 24*a*. It should be understood that the lateral vents 36 could have a different configuration from the internal vents 32.

The illustrated roofing panel assembly 10 includes soffit vents 40 in the base 12. The soffit vents 40 are configured to allow air communication between the two sides of the base 12. This allows air communication between the interior space 38 of the roofing panel assembly 10 and the exterior of the roofing panel assembly 10. The illustrated soffit vents 40 are holes with a circular cross-section cut through the base 12. In the illustrated roofing panel assembly 10, there is one soffit vent 40 between adjacent longitudinal joists 24. The soffit vents 40 could have a different configuration from that illustrated, or there could be a different number of soffit vents 40.

It should be appreciated that the illustrated internal vents 32 and gaps 34 are intended as non-limiting illustrations of ways in which air may move between the interior spaces 38 of the roofing panel assembly 10. Other configurations of ventilation openings can be used to encourage this air movement. In the illustrated embodiment, the interior space 38 is in air communication with each adjacent interior space. It should be appreciated that this is not necessary, and ventilation openings could be configured to provide air flow along a particular path through the roofing panel assembly 10. It should be appreciated that the illustrated lateral vents 36 and soffit vents 40 are intended as non-limiting illustrations of ways in which air may move between the interior spaces 38 of the roofing panel assembly 10 and the exterior of the roofing panel assembly 10. Other configurations of ventilation openings can be used to encourage this air movement. In the illustrated embodiment, each interior space 38 along the edge of the roofing panel assembly 10 is in air communication with the exterior of the roofing panel assembly 10. It should be appreciated that this is not necessary, and ventilation openings could be configured to provide air flow along a particular path through the roofing panel assembly 10. The illustrated ventilation openings are openings or holes, but it should be appreciated that the ventilation openings can be provided with fittings or screens for safety, aesthetics, or to help prevent rain water, insects and animals from entering or moving through the roofing panel assembly 10.

Figure 3:
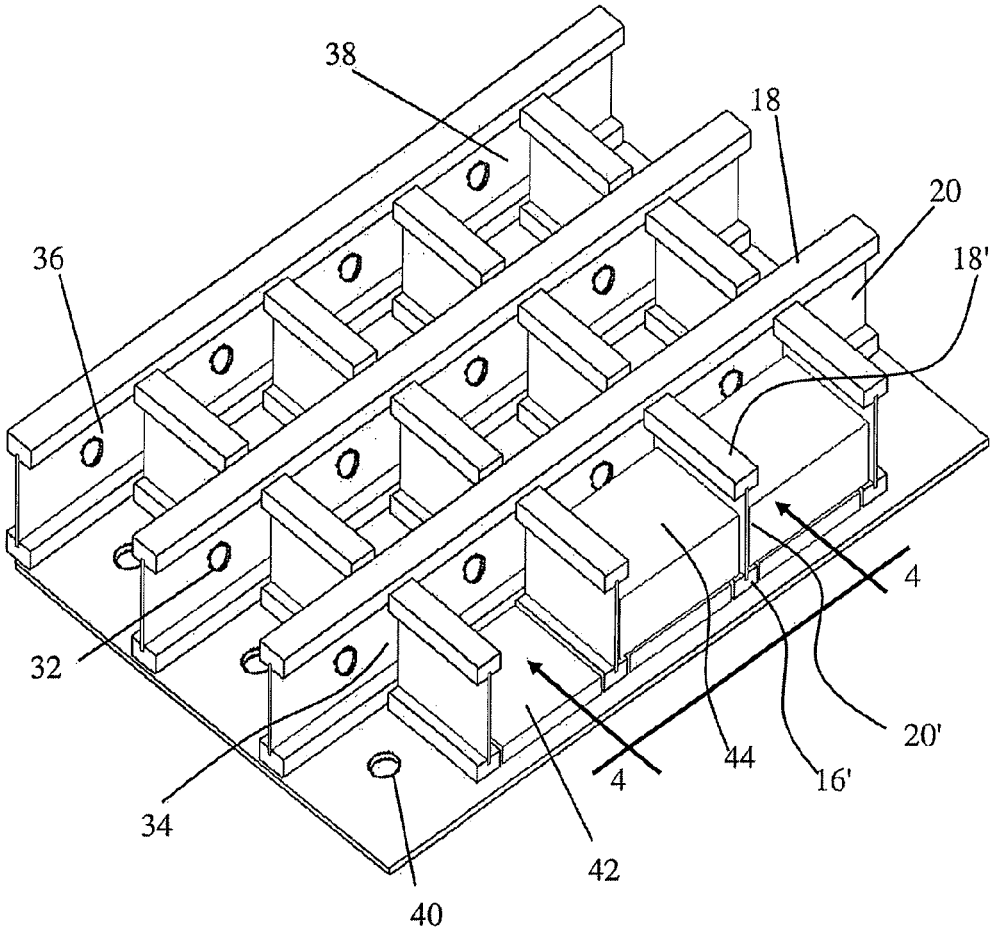
FIG. 3 is a perspective view of the roofing panel assembly similar to the view shown in FIG. 2, with insulation in three of the cells.

Referring now to FIG. 3, the roofing panel assembly 10 of FIG. 2 is shown with optional insulation included in some of the interior spaces 38. The illustrated insulation includes foam sections 42 and fiber glass blankets 44, although other types of insulation can be included. FIG. 3 only shows insulation in three of the interior spaces 38, but it should be understood that insulation will normally be placed in all of the interior spaces 38 that are to be situated over a location requiring insulation. It should be appreciated that the amount of insulation included can be selected to achieve an R-40 or some other desired insulation value or R-value. It should be appreciated that different types and amounts of insulation can be placed in different locations in the roofing panel assembly 10. Further, it should be appreciated that insulation in the roofing panel assembly 10 can provide sound insulation as well as thermal insulation, and the type and amount of insulation included in roofing panel assembly 10 can be selected for its sound absorbing capabilities.

Figure 4:
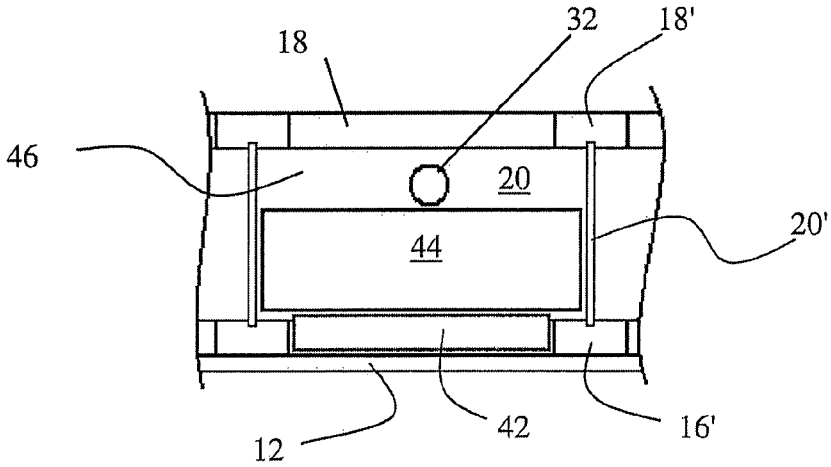
FIG. 4 is a side view of one of the cells of the roofing panel assembly of FIG. 3, the view taken along the line 4-4 in FIG. 3.

As best illustrated in FIG. 4, there is an air channel 46 in the portion of the interior space 38 that is not occupied by foam section 42 or the fiber glass blanket 44. Air channel 46 contributes to the internal venting that helps air move through the roofing panel assembly 10. As shown, air channel 46 is in communication with internal vents 32, gaps 34, lateral vents 36, and soffit vents 40. In the illustrated roofing panel assembly 10, the insulation 42 and 44 is kept clear of the ventilation opening 32, 34, 36, and 40. It should be appreciated that air channel 46 can be configured differently than as illustrated. For instance, insulation can be attached to the base 12 and the cap 22, and air channel 46 can be located between the two layers of insulation. Further, it should be appreciated that if a sufficiently air-permeable insulation is used, air channel 46 could be through the insulation material.

The illustrated roofing panel assembly 10 is configured to be part of a roofing system. In the roofing system, adjacent roofing panel assemblies are configured to be installed on a building, interlocked with each other, and connected to each other. One configuration of the roofing system is described in the following paragraphs.

Referring to FIG. 5, the illustrated roofing panel assembly 10 includes two attachment edges, indicated generally at 52. The illustrated roofing panel assembly 10 includes one edge-most longitudinal joist 24*a* that is not completely covered by the base 12 or the cap 22, as shown on the left side of FIG. 5. That is, a portion of the left-most lower flange 16 and a portion of the left-most upper flange 18 are exposed. These exposed portions provide a tongue, indicated generally at 54. As further illustrated, the opposite end of the roofing panel assembly 10 (on the right side of FIG. 5) includes end portions 12*a* and 22*a* of the base 12 and the cap 22 that extend beyond the end of the lateral joists 30. These extended portions 12*a* and 22*a* define a gap or groove, indicated generally at 56. On the illustrated roofing panel assembly 10, the attachment edges 52 are the tongue 54 and the groove 56, and these attachment edges 52 are configured so that the roofing panel assembly 10 can be assembled in an interlocking manner with adjacent roofing panel assemblies.

Figure 6:
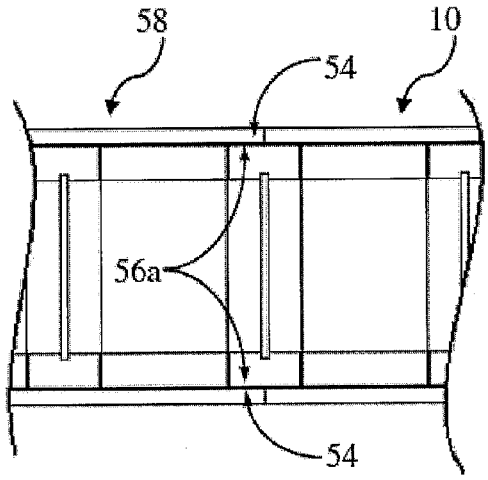
FIG. 6 is an elevational view of portions of two roofing panel assemblies assembled or interlocked together.

Referring to FIG. 6, the tongue 54 of the roofing panel assembly 10 is shown interlocked with a groove 56*a* of a second roofing panel assembly 58. The illustrated second roofing panel assembly 58 is structurally similar to the roofing panel assembly 10, though this is not necessary. The groove 56*a* of the second roofing panel assembly 58 compliments the tongue 54 of the roofing panel assembly 10.

During installation of a roof, roofing panel assembly 10 is placed in position on the building. Roofing panel assembly 10 can be lifted into place by a crane or some other suitable method. The second roofing panel assembly 58 is positioned adjacent to the roofing panel assembly 10, and the two roofing panel assemblies are positioned so that the tongue of roofing panel assembly 10 is disposed within the groove of the second roofing panel assembly 58. The two roofing panel assemblies are then connected or fixed by any suitable means, such as by adhesives, framing nails, or bolting. It should be appreciated that the two roofing panel assemblies can be connected to the building, and can be connected to each other. The tongue-and-groove joint of the two roofing panel assemblies is optionally sealed with adhesive. It should be appreciated that other suitable methods of fastening the roofing panel assemblies to each other could be used.

The illustrated roofing panel assemblies 10 and 58 share one longitudinal joist 24*a*. This is the edge-most longitudinal joist 24*a* of roofing panel assembly 10. It should be appreciated that this is not necessary, and the configuration of the roofing panel assemblies could be changed so that the roofing panel assemblies 10 and 58 share lateral joists, for instance. It should also be appreciated that the roofing panel assemblies do not have to have a tongue-and-groove interconnection with each other. Some other suitable method of interlocking adjacent roofing panel assemblies can be used.

Figure 7:
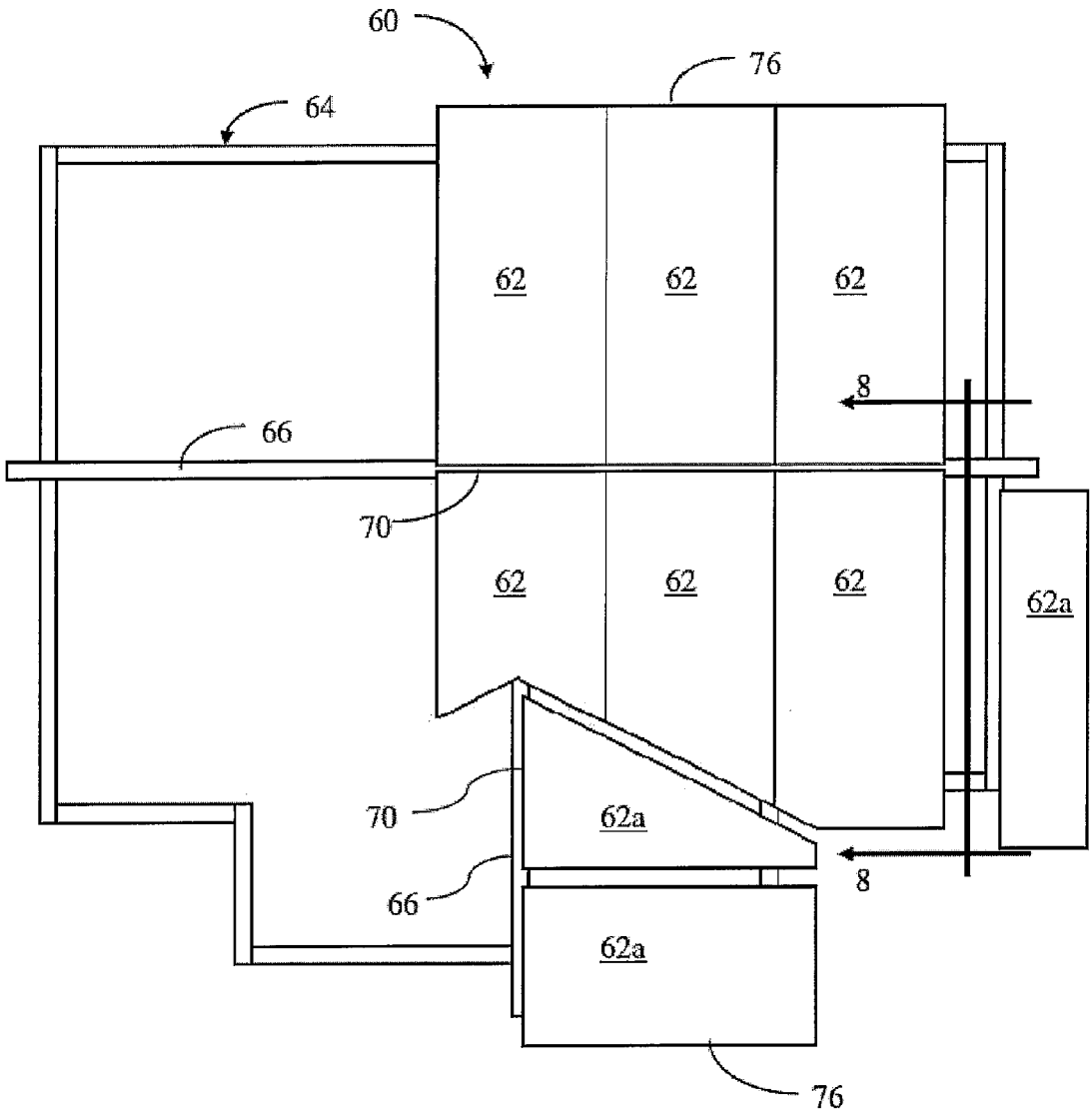
FIG. 7 is a plan view of a building, with a partially-installed roofing system of interlocking roofing panel assemblies.

Referring to FIG. 7, a plan view of a partially-assembled roofing system, indicated at 60, is shown on a building 64. The illustrated building 64 includes a cross-gable roof with ridge beams 66. The roofing system 60 includes a number of prefabricated roofing panel assemblies 62 and 62*a* (nine are shown in FIG. 7). The roofing panel assemblies 62 and 62*a* are of similar construction to roofing panel assembly 10, though they have a variety of different geometries. The size and shape of individual roofing panel assemblies 62 and 62*a* comprising the roofing system 60 can be customized to the particular building 64. The design of the roofing system 60 can be automatically configured from computer aided drafting data for the building 64. It should be appreciated that the roofing system 60 can be configured for installation on a new building 64, or the roofing system 60 can be configured to replace an existing roof on a building, or the roofing system 60 can be configured for installation on an addition to an existing building.

For construction of a roofing system 60, the individual roofing panel assemblies 62, 62*a* are constructed off-site and are taken to the site of the building 64. Constructing the individual roofing panel assemblies 62, 62*a* off-site allows for construction of the roof under factory conditions, and can provide for easier construction and an improved quality at a lower cost than the cost of field construction. The roofing panel assemblies 62, 62*a* can be transported by any suitable method, such as by truck. The roofing panel assemblies 62, 62*a* are moved into position on the building 64. As shown, the size and shape of the different individual roofing panel assemblies 62, 62*a* can vary. Six of the illustrated individual roofing panel assemblies 62 are illustrated in an installed position on the support members of the building 64. Three of the individual roofing panel assemblies 62*a* are illustrated off-set from their final positions, in order to make the underlying building 64 visible. The illustrated roofing system 60 provides structural diaphragm capacity. That is, the shear strength of the base 12 and the cap 22 is able to resist side-loads on the building 64. This increases the capability of the building 64 to resist lateral forces such as wind and earthquake loading.

Figure 8:
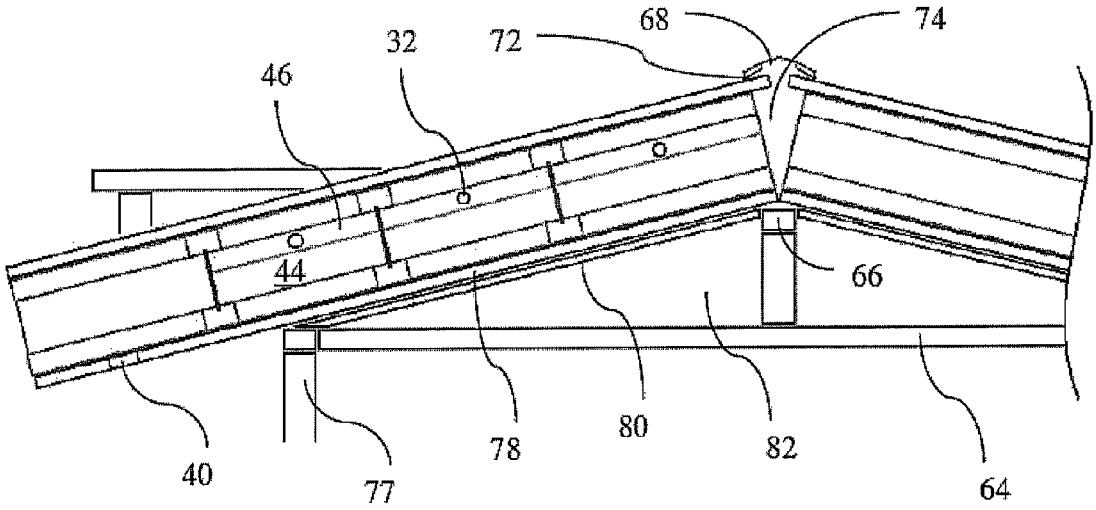
FIG. 8 is an elevational view of the roofing system of FIG. 7, taken along line 8-8.

As best shown in FIG. 8, an optional ridge vent 68 is installed along an upper edge 70 of the roofing system 60. Ridge vent 68 has a gap 72 to allow air flow to and from a space 74 beneath the ridge vent 68. Air channel 46 in the roof panel assemblies 62 is in air communication with the ridge vent 68. This allows air to move through the roofing system 60 as previously described for the roofing panel assembly 10.

It should be appreciated that the roofing system 60 will typically include edges of individual roofing panel assemblies 62 that are exposed. These exposed edges 76, shown in FIG. 7, can exist at the soffit edge of a roofing panel assembly, or at attachment edges which are not adjacent to another roofing panel assembly, for example. Typically, the exposed edges 76 will be covered. The individual roofing panel assemblies 62 can include a pre-installed, finished edge at the exposed edges 76. The pre-installed, finished edge could be installed off-site, during manufacture of the individual roofing panel assembly 62. Alternatively, an edge could be installed on the exposed edges 76 at some other time, for example, on-site after installation of the roofing system 60 on the building 64. Customized eaves can be built to accommodate the specific needs of the building 64. Once the roofing system 60 is installed, any suitable roofing surface, such as roofing shingles, can be applied to the exterior surface.

It should be appreciated that the individual roofing panel assemblies 62 can be built with sufficient structural strength to support themselves so that the individual roofing panel assemblies 62 would not require a truss to support them. The weight of the individual roofing panel assemblies 62 would be supported by the load-bearing walls 77, shown in FIG. 8.

As shown in FIG. 8, an interior surface 78 of the individual roofing panel assemblies 62 can have an interior surface finish 80 pre-installed. The interior surface finish 80 can be dry wall, fiber board, finished wood or some other material. Interior surface finish 80 can be installed on the individual roofing panel assemblies 62 before the individual roofing panel assemblies 62 are installed on the building 64. Installation of the interior finish on the roof panel assembly during construction of the roof panel assembly can reduce ceiling finish costs for the building.

Referring to FIG. 8, an end elevational wall space 82 is shown. It should be appreciated that the elevational wall space 82 is part of one of the exterior walls of the building 64. The elevational wall space 82 could be covered during construction of the wall of building 64. Alternatively, a customized panel (not shown) can be constructed along with the roofing system 60, and that customized panel can be used to cover the elevational wall space 82.

The individual roofing panel assemblies 62 can be custom built in any suitable size, such as sizes up to 8 by 36 feet. It should be appreciated that the size of the roofing panel assemblies 62 may be limited by the available means of transportation to the site of the building 64. The design of a roofing system 60 can be configured from the drawing of a building 64. A roofing system 60 can be customized to fit any structure. On the illustrated roofing panel assembly 10, the base 12, and the cap 22 have substantially the same dimensions and cover substantially the same area when viewed from above. It should be appreciated that this is not necessary, and that the design of the roofing system 60 for a building may require individual roofing panel assemblies 62 that have a base and a cap that are of different shapes, sizes or are offset from each other.

The individual roofing panel assemblies 62 do not require trusses for support and can be secured directly to load bearing walls and ridge beams of the building 64. The individual roofing panel assemblies 62 can be configured to support predicted or calculated snow loads. The roofing panel assemblies 62 can combine structural framing, exterior sheathing, insulation, ventilation, and interior finish into a single product that can be prepared off-site for assembly on-site. The use of the roofing panel assemblies 62 can reduce roof erection time, and simplify the construction of a complex roof, such as a cathedral roof.

The roofing system 60 provides several advantages over conventional roofing systems. The roofing system 60 increases design flexibility, eliminates the need for frequent supports or roof trusses, and allows greater useable space under the roof. The illustrated roofing panel assembly 10 allows for a greater span length than structural insulated panels. Structural insulated panels have a limited unsupported span length due to their relatively low lateral load-carrying capacity.

Figure 9:
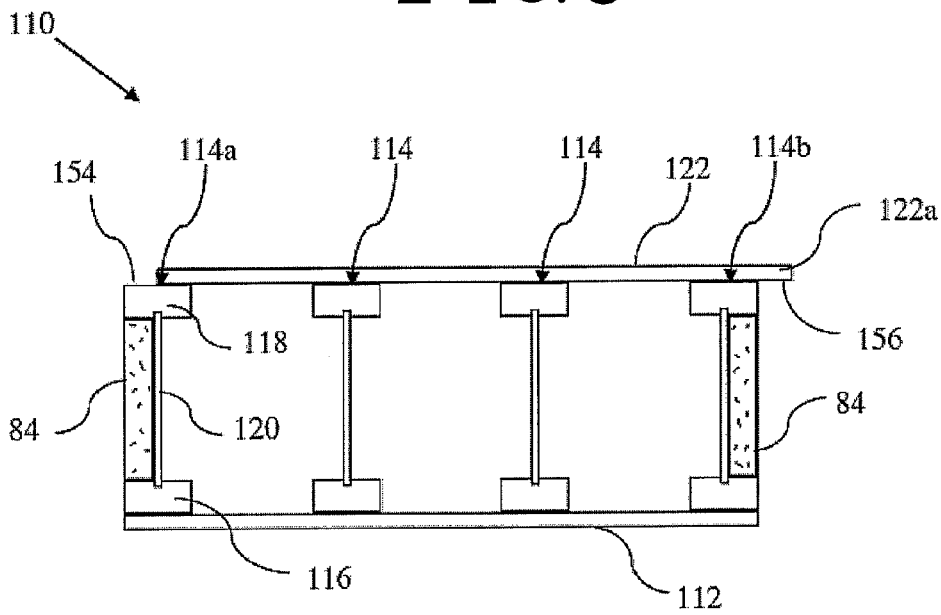
FIG. 9 is an elevational view of a second embodiment of a roofing panel assembly, configured to have a lap joint with adjacent roofing panel assemblies.

Referring to FIG. 9, a roofing panel assembly 110 is shown. The illustrated roofing panel assembly 110 includes a base 112, a cap 122, and four I-joists 114. All the I-joists 114 in roofing panel assembly 110 are oriented in the longitudinal direction and include an upper flange 118, a lower flange 116, and a web 120 extending between the upper flange 118 and the lower flange 116.

The roofing panel assembly 110 is configured to interlock with an adjacent roofing panel assembly using a lap joint. As shown in FIG. 9, the roofing panel assembly 110 includes a first or left-hand edge most I-joist 114*a* and a second or right-hand edge most I-joist 114*b*. The first edge-most I-joist 114*a* (left-hand edge-most I-joist when viewing FIG. 9) is configured to be shared with an adjacent roofing panel assembly. The edge-most I-joist 114*a* is not completely covered by the cap 122. That is, a portion 154 of a first upper flange 118 not covered by the cap 122 (left-most upper flange when viewing FIG. 9) is exposed. This exposed portion 154 defines a first half of a lap joint. As further illustrated, the opposite edge of the roofing panel assembly 110 (the right side when viewing FIG. 9) includes an end portion 122*a* of the cap 122 that extends beyond the edge of a second edge-most I-joist 114*b* (right-hand edge-most I-joist when viewing FIG. 9). A surface 156 (lower surface when viewing FIG. 9) of the end portion 122*a* defines a second half of a lap joint. It should be appreciated that roofing panel assembly 110 can be positioned adjacent to a second, similar roofing panel assembly such that the second half 156 of one roofing panel assembly will overlap the first half 154 of the other roofing panel assembly. The two roofing panel assemblies can then be connected by any suitable means, such as by adhesives, framing nails, or bolts.

It should be appreciated that when two roofing panel assemblies similar to 110 are interlocked, they will share I-joist 114*a* of the first roofing panel assembly. It should further be appreciated that I-joist 114*b* of the second roofing panel assembly will be adjacent the shared I-joist 114*a*. The roofing panel assembly 110 may include joint insulation 84 to insulate the resulting space between I-joists 114*a* and 114*b*. The illustrated joint insulation 84 can be a rigid foam insulation glued to the web 120 and flush with the edge of the roofing panel assembly 110, or some other type of insulation could be used, such as an adhering, expanding gasket. Since I-joists 114*a* and 114*b* of the interlocked roofing panel assemblies are closer together than the other I-joists in the roofing panel assembly, I-joists 114*a* and 114*b* can be designed with a lower load capacity than I-joists 114, while still maintaining the ability to the roofing panel assembly 110 to support loads.

It should be appreciated that the roof panel assemblies can be used without interlocking adjacent roof panel assemblies. Obviously, if a single roofing panel assembly is used to cover a building or a portion of a building, there would be no adjacent roofing panel assembly to interlock with. Further, adjacent roofing panel assemblies 10 and 58 do not have to be interlocked, and could simply be positioned adjacent to each other.

Figure 10:
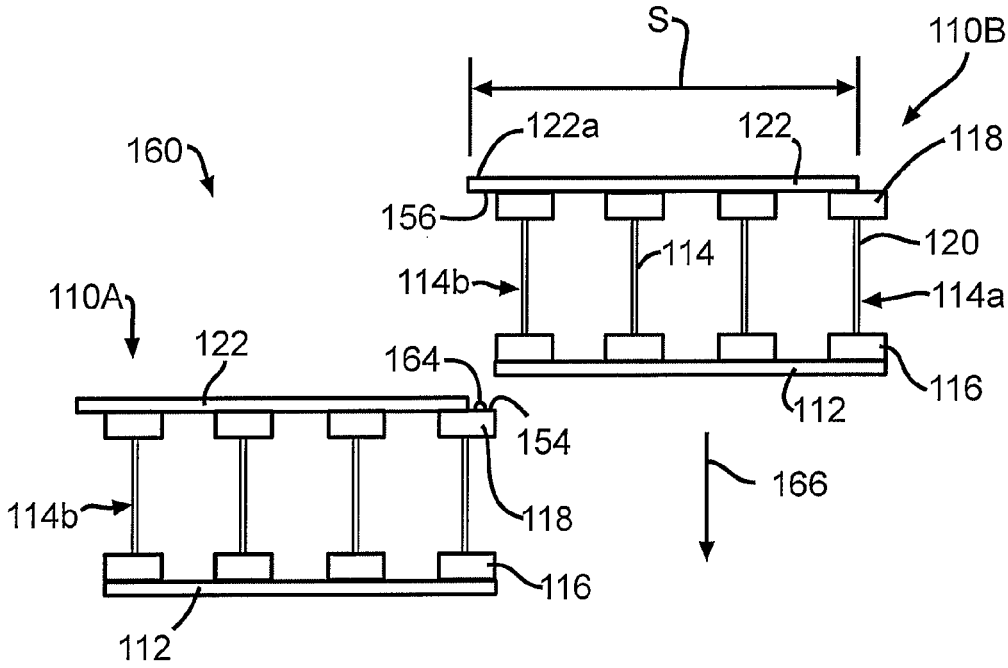
FIG. 10 is an elevational view, partially exploded, of a portion of a first embodiment of a roofing system according to the invention.
Figure 11:
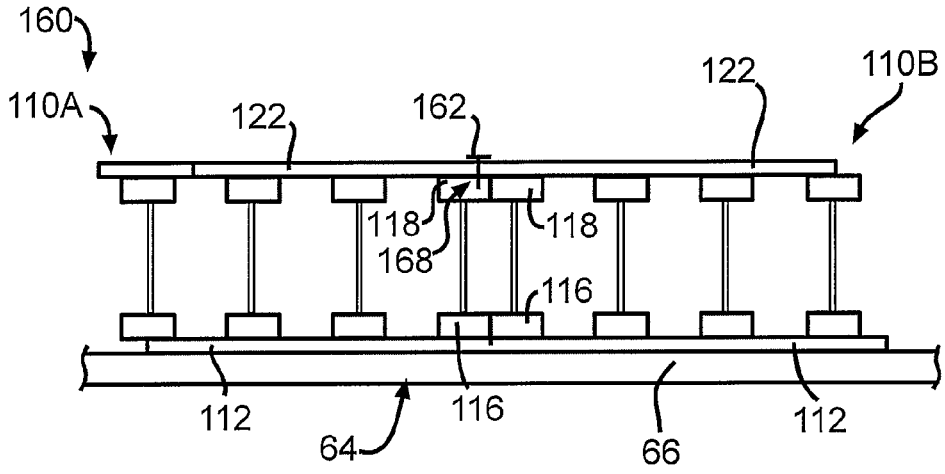
FIG. 11 is an elevational view of the roofing system illustrated in FIG. 10, showing the roofing system assembled.

Referring now to FIGS. 10 and 11, a portion of a first embodiment of a roofing system is shown at 160. The roofing system 160 includes two interlocked roofing panel assemblies 110A and 110B. Each of the roofing panel assemblies 110A and 110B is substantially identical to the roofing panel assembly 110 shown in FIG. 9, and like reference numerals will be used to indicate corresponding parts.

When assembling the roofing system 160, the roofing panel assemblies 110A and 110B may be installed vertically (in the direction of the arrow 166) onto a portion of a building roof 64, such at the ridge beam schematically illustrated at 66 in FIG. 11. As shown in FIG. 11, after a first roofing panel assembly 110A is disposed on the roof 64, a second roofing panel assembly 110B is then moved vertically (downwardly in the direction of the arrow 166 when viewing FIGS. 10 and 11) onto the roof 64 such that the end portion 122*a* of the cap 122 of the roofing panel assembly 110B overlaps the exposed portion 154 of the upper flange 118 of the roofing panel assembly 110A. When assembled together as shown in FIG. 11, the exposed portion 154 and the lower surface 156 define a lap joint 168.

The roofing panel assembly 110B may be fastened to the roofing panel assembly 110A by any desired means. In the illustrated embodiment, the roofing panel assembly 110B is fastened to the roofing panel assembly 110A by a mechanical fastener 162. The mechanical fastener 162 may be any desired fastener, such as a nail, staple, or threaded fastener. If desired, adhesive 164, such as a water-resistant adhesive, may be applied to the lap joint 168 between the exposed portion 154 and the lower surface 156.

Figure 12:
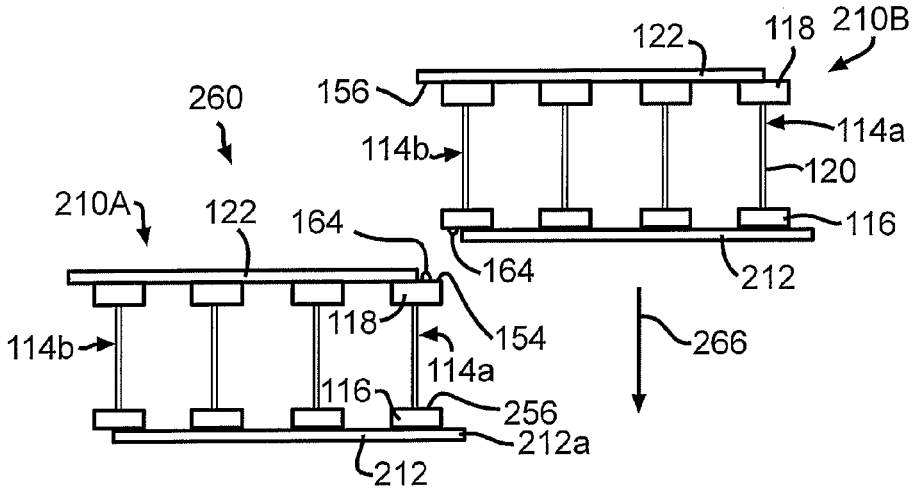
FIG. 12 is an elevational view, partially exploded, of a portion of a second embodiment of a roofing system according to the invention.
Figure 13:
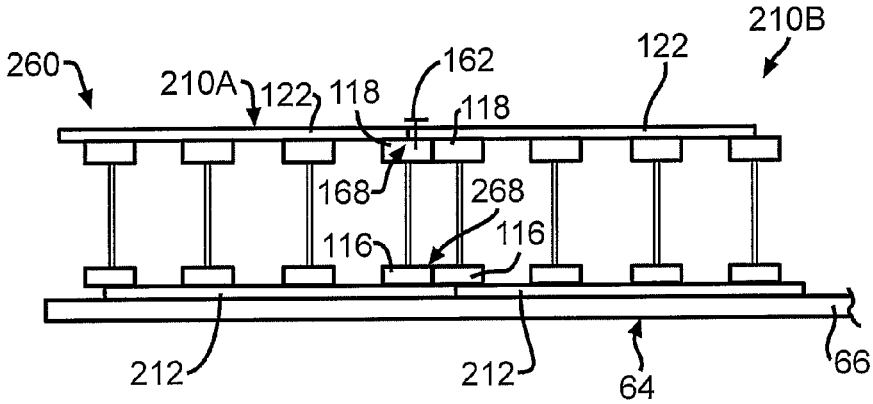
FIG. 13 is an elevational view of the roofing system illustrated in FIG. 12, showing the roofing system assembled.

Referring now to FIGS. 12 and 13, a portion of a second embodiment of a roofing system is shown at 260. The roofing system 260 includes two interlocked roofing panel assemblies 210A and 210B. Each of the roofing panel assemblies 210A and 210B is substantially similar to the roofing panel assembly 110 and like reference numerals will be used to indicate corresponding parts. Rather than the base 112, the roofing panel assemblies 210A and 210B include a base 212.

The base 212 of the roofing panel assembly 210A, 210B is configured to interlock with the base 212 of an adjacent roofing panel assembly 210A, 210B using a lap joint. As shown in FIGS. 12 and 13, the second edge-most I-joist 114*b* (left-hand edge-most I-joist when viewing FIG. 12) is configured to be shared with an adjacent roofing panel assembly. The edge-most I-joist 114*b* is not completely covered by the base 212. That is, a portion 254 of the lower flange 116 is exposed. This exposed portion 254 defines a first half of a lap joint. As further illustrated, the opposite edge of the roofing panel assembly 210A, 210B (the right side when viewing FIG. 12) includes an end portion 212*a* of the base 212 that extends beyond the edge of the first edge-most I-joist 114*a* (right-hand edge-most I-joist when viewing FIG. 12). A surface 256 (upper surface when viewing FIG. 12) of the end portion 212*a* defines a second half of a lap joint. It should be appreciated that the roofing panel assembly 210A can be positioned adjacent the roofing panel assembly 210B, such that the surface 256 of the roofing panel assembly 210A will overlap the exposed portion 254 of the roofing panel assembly 210B. The two roofing panel assemblies 210A, 210B can then be connected by any suitable means, such as by adhesives, framing nails, or bolts.

When assembling the roofing system 260, the roofing panel assemblies 210A and 210B may be installed vertically (in the direction of the arrow 266) onto a portion of a building roof 64, such at the ridge beam schematically illustrated at 66 in FIG. 13. As shown in FIG. 13, after a first roofing panel assembly 210A is disposed on the roof 64, a second roofing panel assembly 210B is then moved vertically (downwardly in the direction of the arrow 266 when viewing FIGS. 12 and 13) onto the roof 64 such that the end portion 122*a* of the cap 122 of the roofing panel assembly 210B overlaps the exposed portion 154 of the upper flange 118 of the roofing panel assembly 110A. When assembled together as shown in FIG. 11, the exposed portion 154 and the lower surface 156 define a lap joint 168.

Similarly, the end portion 212*a* of the base 212 of the roofing panel assembly 210A overlaps the exposed portion 254 of the lower flange 116 of the roofing panel assembly 210B. When assembled together as shown in FIG. 13, the exposed portion 254 and the lower surface 256 define a lap joint 268.

The roofing panel assembly 210B may be fastened to the roofing panel assembly 210A by any desired means. In the illustrated embodiment, the roofing panel assembly 210B is fastened to the roofing panel assembly 210A by a mechanical fastener 162. The mechanical fastener 162 may be any desired fastener, such as a nail, staple, or threaded fastener. If desired, adhesive 164, such as a water-resistant adhesive, may be applied to the lap joints 168, 268 between the exposed portion 154 and the lower surface 156, and between the exposed portion 254 and the upper surface 256.

Advantageously, the interlocked roofing panel assemblies 110A and 110B of the roofing system 160 shown in FIGS. 10 and 11, and the interlocked roofing panel assemblies 210A and 210B of the roofing system 260 shown in FIGS. 12 and 13 provide enhanced gravity, or vertical, load-carrying capacity. Additionally, the roofing panel assemblies 110A, 110B, 210A, 210B have the ability to transfer shear stresses caused by lateral loads, such as caused by wind and seismic events, to the supporting structure, such as the roof 64. In the embodiment illustrated in FIGS. 10 through 13, the top layers of sheathing or caps 122 are field-fastened to an adjacent panel assembly so that the caps 122 act as a horizontal diaphragm.

In the embodiment illustrated in FIGS. 12 and 13, both the caps 122 and the bases 112 are fastened to an adjacent panel assembly. The bottom layers of sheathing or bases 112 then also act as a horizontal diaphragm which can be easily attached to a structure, such as a supporting vertical or load-bearing wall 77.

Advantageously, the methods of inter-panel connection illustrated in FIGS. 12 and 13 are easily achieved in the field. As shown in FIGS. 10 through 12, the roofing panel assemblies 110A, 110B, 210A, 210B may be moved or dropped vertically into place (in the direction of the arrows 166 and 266). Unlike other commercially-produced roof panels, the roofing panel assemblies 110A, 110B, 210A, 210B do not require special connectors.

In the illustrated embodiments, the base 122 of each panel assembly 110, 110A, 110B, 210A, and 210B, is oriented with its strong direction, i.e., the direction of the grain of the wood, in the direction of the panel span S to maximize the additional strength and stiffness provided by the base 122.

As discussed above, the mechanical fastener 162 may be any desired fastener, such as a nail, staple, or threaded fastener, or combination of such fasteners. Water-resistant adhesive 164 may also be applied to the lap joint 168. The fasteners 162 serve a dual purpose of providing clamping pressure to the adhesive 164 while the adhesive 164 cures, and further enhancing strength and stiffness of the roofing system 160 and 260, by aiding in transferring shear stresses between the caps 122, the bases 112, and the I-joists 114.

Figure 15:
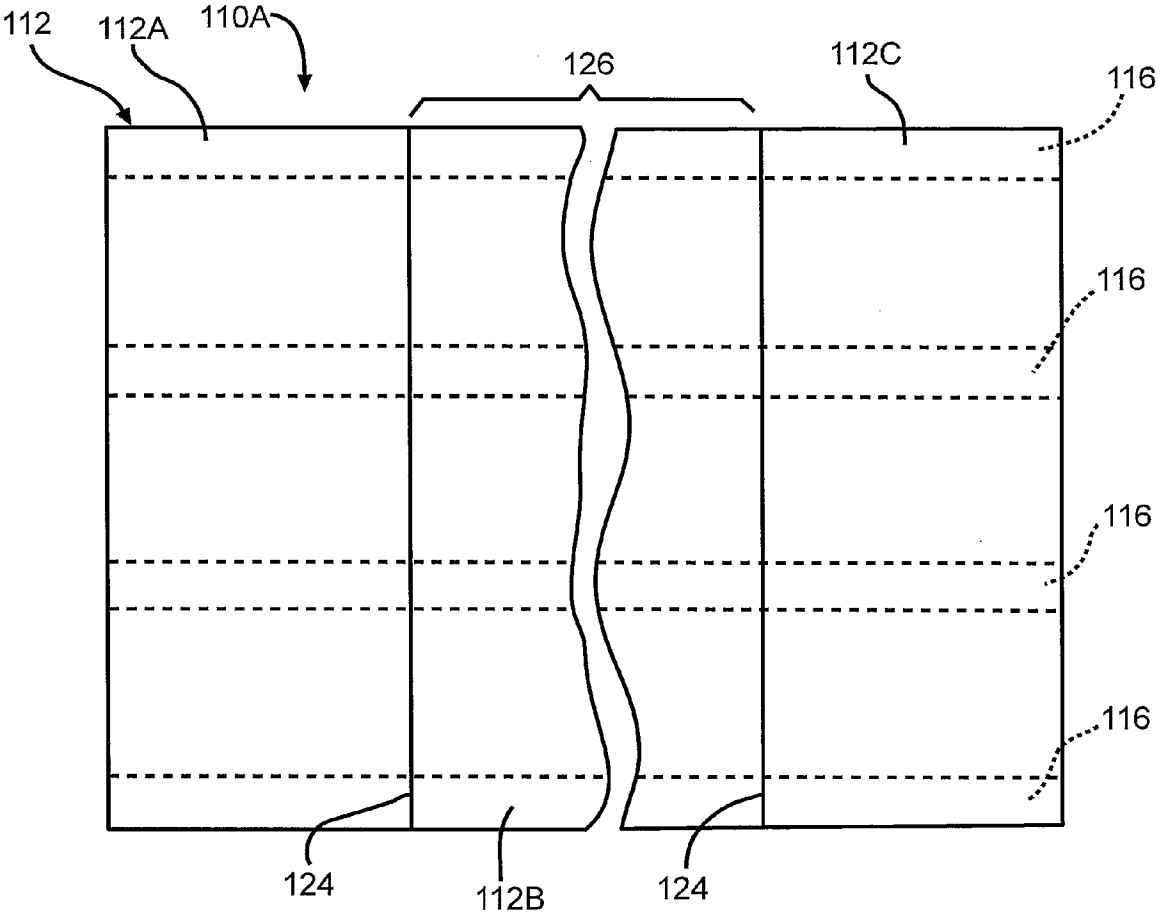
FIG. 15 is a bottom plan view of the roofing system illustrated in FIG. 10.

As best shown in FIG. 15, the base 112 of the roofing panel assembly 110A may be formed from component base panel sections. In the embodiment illustrated in FIG. 15, three base panel sections are shown at 112A, 112B, and 112C. Transversely extending joints 124 are defined between adjacent base panel sections. Although not illustrated, it will be understood that the cap 122 may also comprise a plurality of component cap panel sections.

It will be understood that the upper and lower flanges 118 and 116, respectively, may include naturally occurring defects such as by splices, knots, and the like. If a joint 124 between adjacent base panel sections is positioned over such a defect, the strength of the roofing panel assembly 110A may be undesirably reduced. To mitigate the negative effect of such reduced strength of the roofing panel assembly 110A, the joints 124 may be selectively positioned such that the joints 124 do not intersect any naturally occurring defect in the flanges 118 and 116.

It will also be understood that if a joint 124 between adjacent base panel sections is positioned in a high stress region of the roofing panel assembly 110A, such as a central region 126 of the roofing panel assembly 110A, the strength of the roofing panel assembly 110A may also be undesirably reduced. Accordingly, the joints 124 may be selectively positioned such that the joints 124 are not positioned in the central region 126 of the roofing panel assembly 110A.

Figure 14:
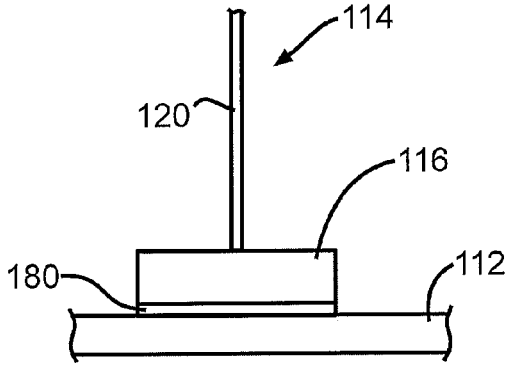
FIG. 14 is an enlarged view of a third embodiment of a roofing system.

To further reduce the potential negative effect on the strength of the panel assemblies 110A, 110B, 210A, and 210B caused by splices, knots, and other naturally occurring defects in the I-joist flanges 116 and 118, fiber-reinforced polymer (FRP) reinforcing material 180 may be selectively applied between the lower flange 116 of the I-joist 114 and the base 112, as shown in FIG. 14. The addition of FRP reinforcing material will enhance panel assembly strength by preventing failure from initiating at the location of these defects, i.e., a splice, knot, or other naturally occurring defect.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A roofing system comprising:

a plurality of roofing panel assemblies, each roofing panel assembly having:

a base having a substantially planar surface;

a plurality of I-joists having an upper flange, a lower flange, and a web, wherein the base is attached to the lower flanges of the plurality of I-joists; and a cap having a substantially planar surface, wherein the cap is attached to the upper flanges of the plurality of I-joists;

wherein the plurality of I-joists includes a first edge most I-joist and a second edge most I-joist, wherein a first edge of the cap is attached to the upper flange of the first edge most I-joist such that a portion of the upper flange of the first edge most I-joist is not covered by the cap, the portion defining a first distance, and wherein a second edge of the cap extends beyond an edge of the second edge most I-joist for a second distance less than a width of the upper flange of the second edge most I-joist;

wherein the second distance is also less than or equal to the first distance;

wherein a first edge of the base is attached to the lower flange of the first edge most I-joist such that the first edge of the base extends outwardly no further than an edge of the lower flange of the first edge most I-joist;

wherein a second edge of the base is attached to the lower flange of the second edge most I-joist such that the second edge of the base extends outwardly no further than an edge of the lower flange of the second edge most I-joist; and wherein adjacent roofing panel assemblies are attached such that the second edge of the cap engages the portion of the upper flange of the first edge most I-joist not covered by the cap.

2. The roofing system according to claim 1, wherein the web extends between the upper flange and the lower flange.

3. The roofing system according to claim 1, further including a fastener extending through the second attachment edge of the cap and into the upper flange of an I-joist of an adjacent roofing panel assembly.

4. The roofing system according to claim 3, wherein the fastener is a mechanical fastener.

5. The roofing system according to claim 3, further including adhesive between the second attachment edge of the cap and the upper flange of an I-joist of an adjacent roofing panel assembly.

6. The roofing system according to claim 1, further including adhesive between the second attachment edge of the cap and the upper flange of an I-joist of an adjacent roofing panel assembly.

7. The roofing panel assembly of claim 1, wherein the I-joists are longitudinal joists, the roofing panel assembly further including a lateral joist oriented substantially perpendicular to the longitudinal joists.

8. The roofing panel assembly of claim 1, wherein the base, the cap, and the I-joists are made of wood.

9. A roofing system comprising:

a plurality of roofing panel assemblies, each roofing panel assembly having:

a base having a substantially planar surface;

a plurality of I-joists having an upper flange, a lower flange, and a web, the upper flange defining an upper notch, wherein one edge of the web is inserted into the upper notch, the lower flange defining a lower notch, wherein one edge of the web is inserted into the lower notch, and wherein the base is attached to the lower flange of one or more of the plurality of I-joists, the I-joists configured such that one or more cells are created between adjacent I-joists;

a cap having a substantially planar surface, wherein the cap is attached to the upper flange of one or more of the plurality of I-joists; and ventilation openings configured to provide air communication from one of one cell to at least one adjacent cell, and from one cell to the exterior of the roofing panel assembly;

wherein the plurality of I-joists includes a first edge most I-joist and a second edge most I-joist, wherein a first edge of the cap is attached to the upper flange of the first edge most I-joist such that a portion of the upper flange of the first edge most I-joist is not covered by the cap, the portion defining a first distance, and wherein a second edge of the cap extends beyond an edge of the second edge most I-joist for a second distance less than a width of the upper flange of the second edge most I-joist;

wherein the second distance is also less than or equal to the first distance; and wherein adjacent roofing panel assemblies are attached such that the second edge of the cap engages the portion of the upper flange of the first edge most I-joist not covered by the cap.

10. The roofing panel assembly of claim 9, wherein a first edge of the base is attached to the lower flange of the first edge most I-joist such that the first edge of the base extends outwardly no further than an edge of the lower flange of the first edge most I-joist; and wherein a second edge of the base is attached to the lower flange of the second edge most I-joist such that the second edge of the base extends outwardly no further than an edge of the lower flange of the second edge most I-joist.

* * * * *